US011172777B1

(12) United States Patent
Ausland

(10) Patent No.: US 11,172,777 B1
(45) Date of Patent: Nov. 16, 2021

(54) MOBILE EXPANDABLE HARD SIDED PACKAGE SECURITY DROP BOX

(71) Applicant: Loran Patrick Ausland, Gallatin, TN (US)

(72) Inventor: Loran Patrick Ausland, Gallatin, TN (US)

( * ) Notice: Subject to any disclaimer, the term of this patent is extended or adjusted under 35 U.S.C. 154(b) by 0 days.

(21) Appl. No.: 15/930,247

(22) Filed: May 12, 2020

(51) Int. Cl.
*A47G 29/20* (2006.01)
*A47G 29/30* (2006.01)
*A47G 29/14* (2006.01)

(52) U.S. Cl.
CPC ..... *A47G 29/20* (2013.01); *A47G 29/30* (2013.01); *A47G 2029/144* (2013.01)

(58) Field of Classification Search
CPC ..... A47G 29/20; A47G 29/30; A47G 29/14; A47G 29/141; A47G 29/16; A47G 2029/144; A47G 2029/148; A47G 2029/149
USPC ..... 232/17, 19, 38, 45; 220/8, 666
See application file for complete search history.

(56) References Cited

U.S. PATENT DOCUMENTS 1,847,969 A * 3/1932 Marks ..... A47G 29/20 232/42
5,624,071 A * 4/1997 Sosan ..... A47G 29/20 232/1 B
5,878,903 A * 3/1999 Ung ..... B65D 88/005 220/8
6,155,715 A * 12/2000 Lake ..... A47G 29/20 150/102
6,375,070 B1 * 4/2002 Snoke ..... A47G 29/141 232/20
9,873,549 B2 * 1/2018 Heinz ..... A47G 29/141
10,143,321 B2 * 12/2018 Hippert ..... A47G 29/20
10,292,519 B1 * 5/2019 Sutton ..... A47G 29/1209
10,321,780 B1 * 6/2019 James ..... A47G 29/141
10,383,471 B1 * 8/2019 Barnes ..... A47G 29/20
10,512,352 B1 * 12/2019 Torres ..... A47G 29/22
10,537,196 B1 * 1/2020 MacPherson ..... A47G 29/20
10,537,197 B2 * 1/2020 Hopp ..... A47G 29/20
10,682,002 B2 * 6/2020 Miller ..... A47G 29/20
10,696,453 B2 * 6/2020 Sena ..... A47G 29/141
10,709,276 B2 * 7/2020 Guanch ..... A47G 29/20
10,743,693 B2 * 8/2020 Newcomb ..... G07C 9/00896
10,772,451 B2 * 9/2020 Vernal Silva ..... A47G 29/141
10,932,602 B2 * 3/2021 Hauck ..... A47G 29/12095
2003/0006275 A1 * 1/2003 Gray ..... A47G 29/141 232/19
2016/0051073 A1 * 2/2016 Heinz ..... A47G 29/141 232/39

(Continued)

*Primary Examiner* — William L Miller
(74) *Attorney, Agent, or Firm* — Mark A. Pitchford; Eric B. Fugett; Pitchford Fugett, PLLC

(57) ABSTRACT

A package drop box includes a base, a cap, and a retention bracket. The base has an open top. The cap has an open bottom. In a first position, the cap is fitted over the base such that a bottom edge of the cap is proximate a bottom edge of the base. In the second position, the bottom edge of the cap is proximate a top edge of the base. The retention bracket is configured to secure to the base. The retention bracket is configured to extend up a back of the base from the surface supporting the package drop box, extend along the surface away from the back of the base, and extend vertically upward from the surface supporting the package drop box at a predetermined distance from the back of the base.

19 Claims, 5 Drawing Sheets

(56) References Cited

U.S. PATENT DOCUMENTS

| | | | | |
|---|---|---|---|---|
| 2016/0068306 | A1* | 3/2016 | Heinz | B65D 81/02 220/560.01 |
| 2016/0309939 | A1* | 10/2016 | Mencel | A47G 29/20 |
| 2016/0331171 | A1* | 11/2016 | Jiang | G06Q 10/0833 |
| 2017/0188737 | A1* | 7/2017 | Hippert | A47G 29/20 |
| 2018/0228310 | A1* | 8/2018 | Enobakhare | A47G 29/1207 |
| 2018/0296016 | A1* | 10/2018 | Teoh | A47G 29/20 |
| 2019/0231104 | A1* | 8/2019 | Dunkelberger | E05B 73/00 |
| 2019/0256119 | A1* | 8/2019 | Brilhante | A47G 29/124 |
| 2019/0350398 | A1* | 11/2019 | Raphael | A47G 29/141 |
| 2020/0107663 | A1* | 4/2020 | Eivaz | A47G 29/20 |
| 2020/0380465 | A1* | 12/2020 | Newcomb | A47G 29/141 |
| 2021/0127880 | A1* | 5/2021 | Raphael | A47G 29/141 |

* cited by examiner

MOBILE EXPANDABLE HARD SIDED PACKAGE SECURITY DROP BOX

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to package delivery systems and methods. More particularly, this invention pertains to a system for securing packages at a recipient's residence when the package recipient is not present.

With the increase in online shopping, consumers are increasingly reliant on package delivery systems for a variety of items including consumables, electronics, and luxury goods. As the delivery of high value goods has increased, so has package theft. Packages are typically left by a garage door or front door by a package delivery service (e.g., USPS, UPS, or FEDEX). Packages left completely unsecured at the main entrance to an unoccupied residence are ideal targets for package thieves. Many consumers would like a system that allows a delivery person to secure a package, but the consumers do not want to grant access to the home or garage to every package delivery person. Further, consumers do not want to go to the time and expense of permanently installing a package drop system, and delivery persons do not want to figure out each recipient's individual package delivery system.

BRIEF SUMMARY OF THE INVENTION

Aspects of the present invention provide a mobile, expandable package drop security box. The package drop box includes wheels for rolling the box out of and back into a user's garage. The box includes a base with an open top and a cap fitted over the base. The cap lowers onto the base for reduced storage size, and the cap locks into an upper position on the base to expand and accommodate larger packages inside the package drop box. The package drop box includes a retention bracket that extends down from a back of the base, along a surface supporting the base (e.g., wheels spacing the base from the surface), and extends up from the surface at a predetermined distance from the base. The predetermined distance is sized to accept a standard garage door (e.g., about 5 inches) such that the garage door can be closed on the retention bracket, and the retention bracket prevents the package drop box from being moved until the garage door is opened.

In one aspect, a package drop box includes a base, a cap, and a retention bracket. The base has an open top. The cap has an open bottom. The cap has a first position and a second position relative to the base. The cap is configured to secure to the base when the package drop box is assembled. In the first position, the cap is fitted over the base such that a bottom edge of the cap is proximate a bottom edge of the base. In the second position, the bottom edge of the cap is proximate a top edge of the base. The retention bracket is configured to secure to the base when the package drop box is assembled. The retention bracket is configured to extend up a back of the base from the surface supporting the package drop box, extend along the surface away from the back of the base, and extend vertically upward from the surface supporting the package drop box at a predetermined distance from the back of the base when the package drop box is assembled, in an upright position, and supported by the surface.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
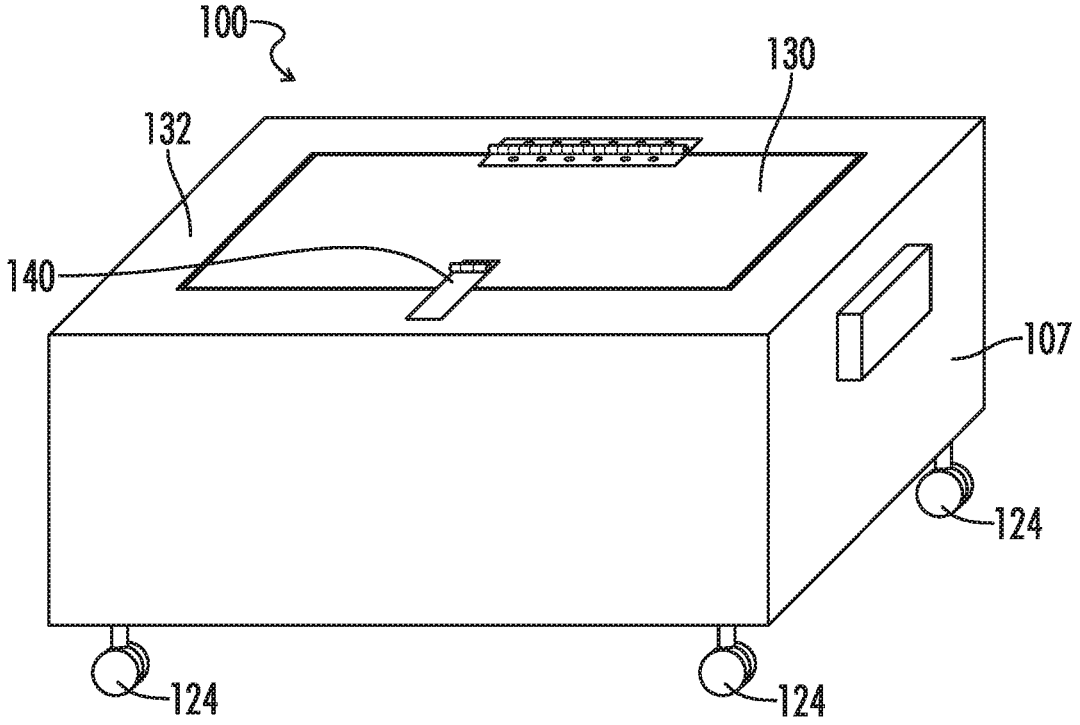
FIG. 1 is an isometric view of a package drop box in a first position according to one embodiment of the invention.
Figure 2:
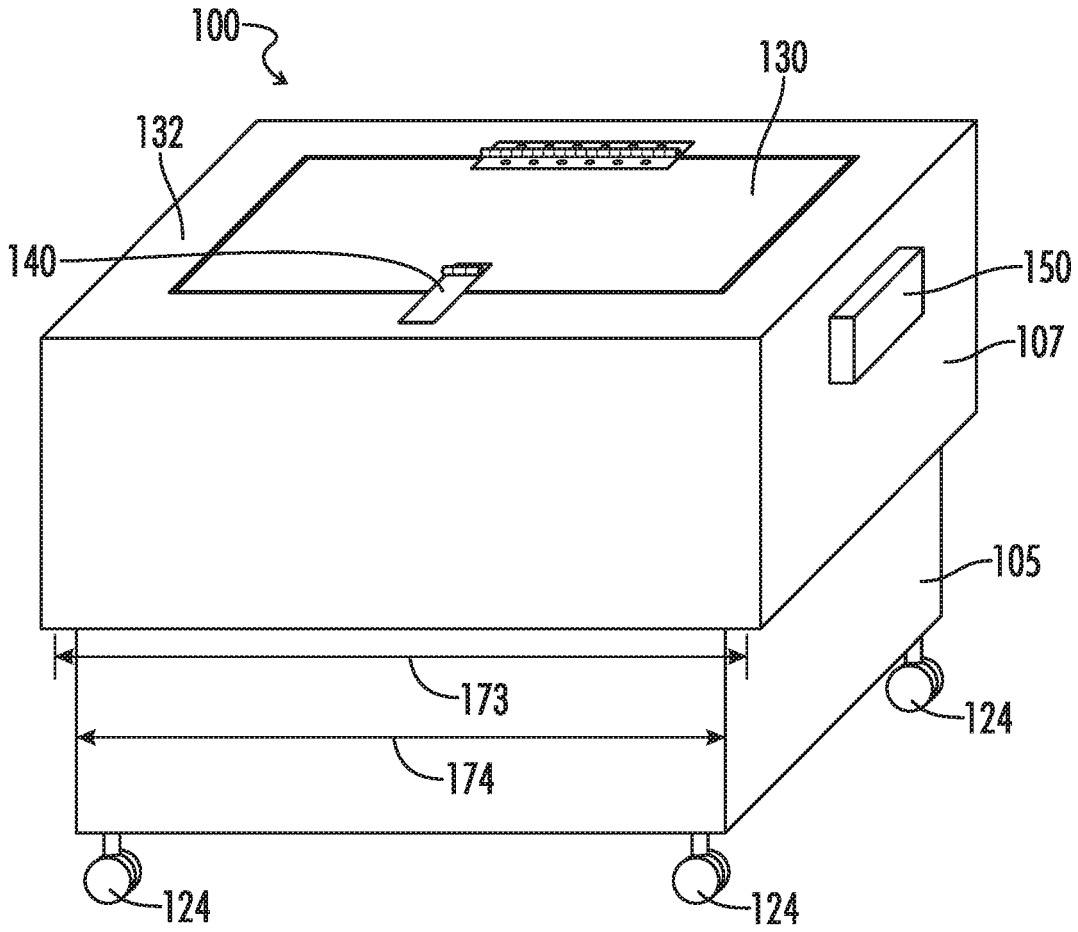
FIG. 2 is an isometric view of the package drop box of FIG. 1 in a second position.
Figure 3:
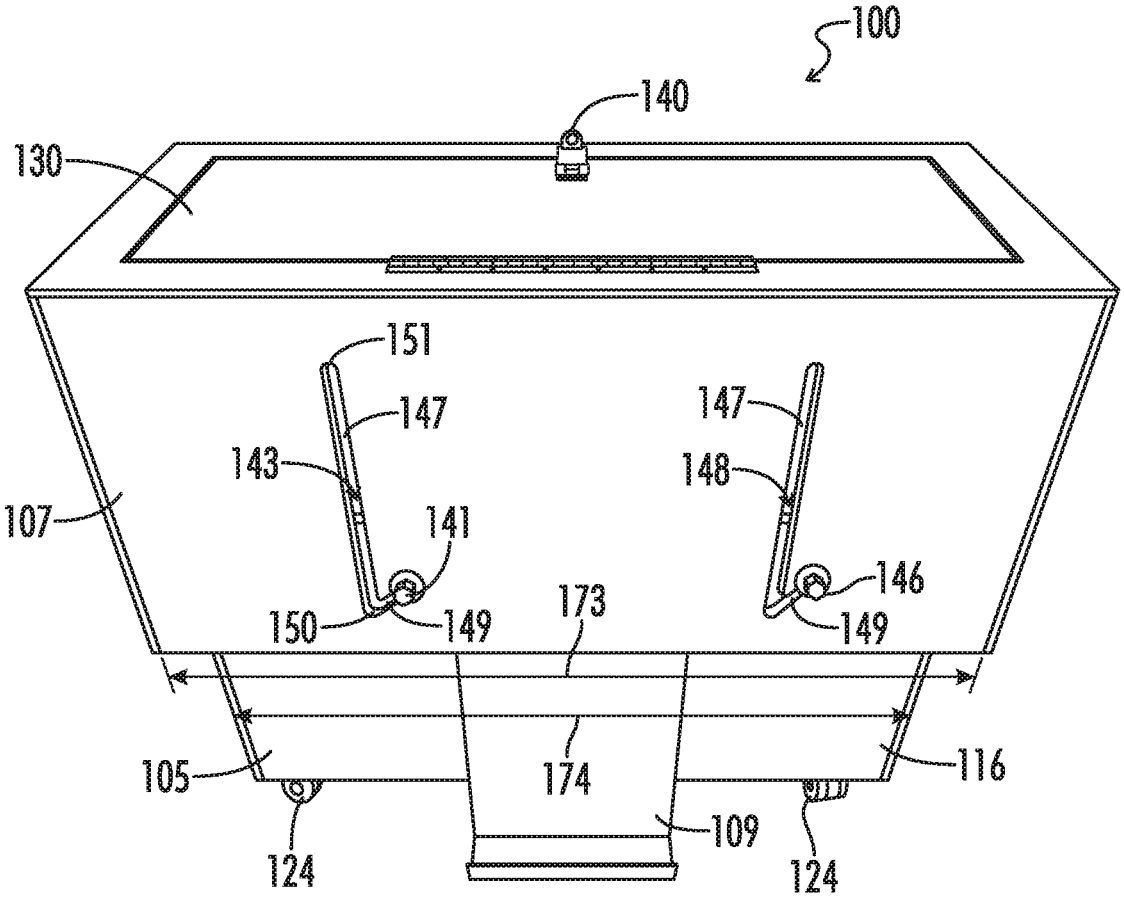
FIG. 3 is an elevated rear perspective view of the package drop box of FIG. 1.
Figure 4:
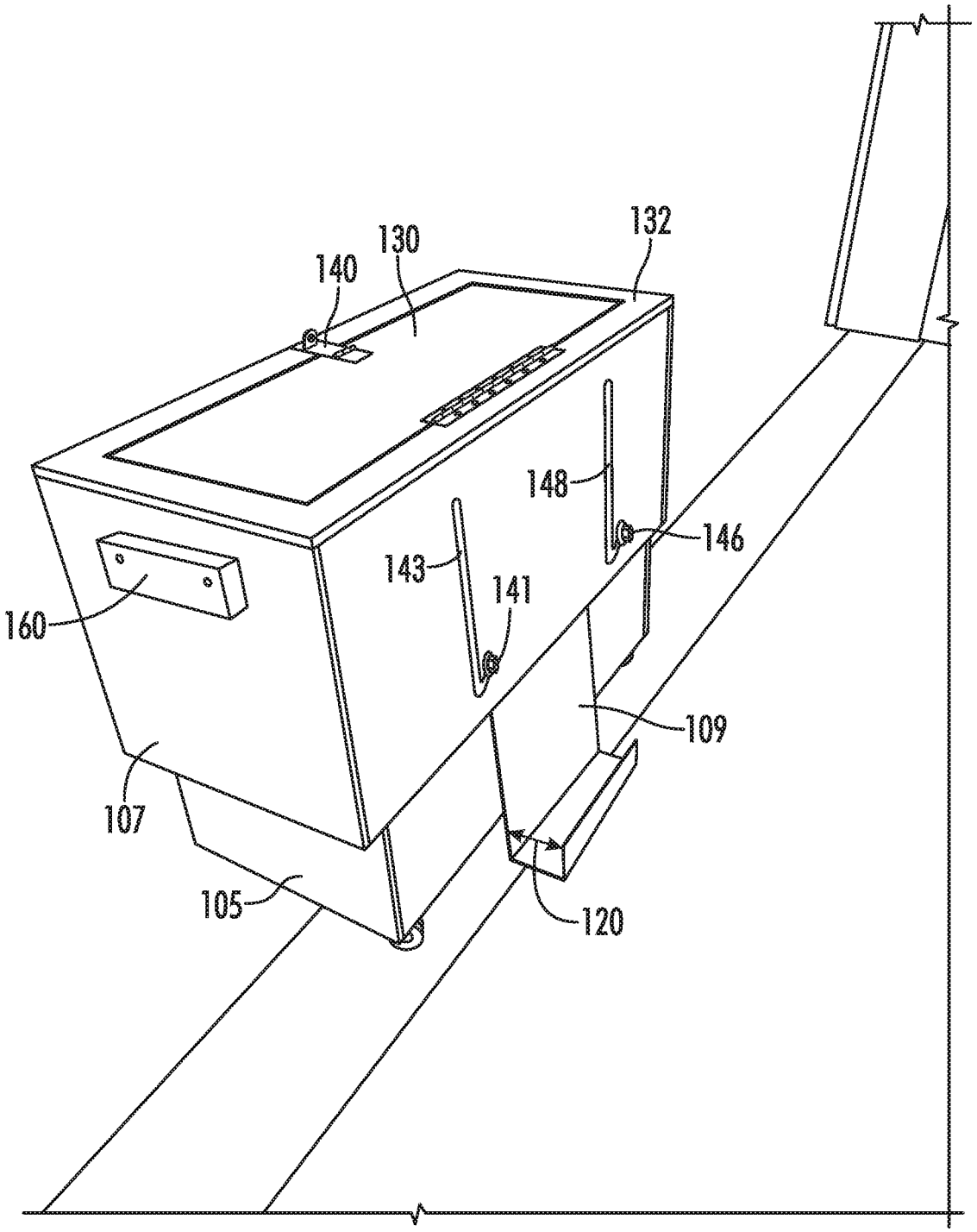
FIG. 4 is a rear isometric view of the package drop box of FIG. 1.
Figure 5:
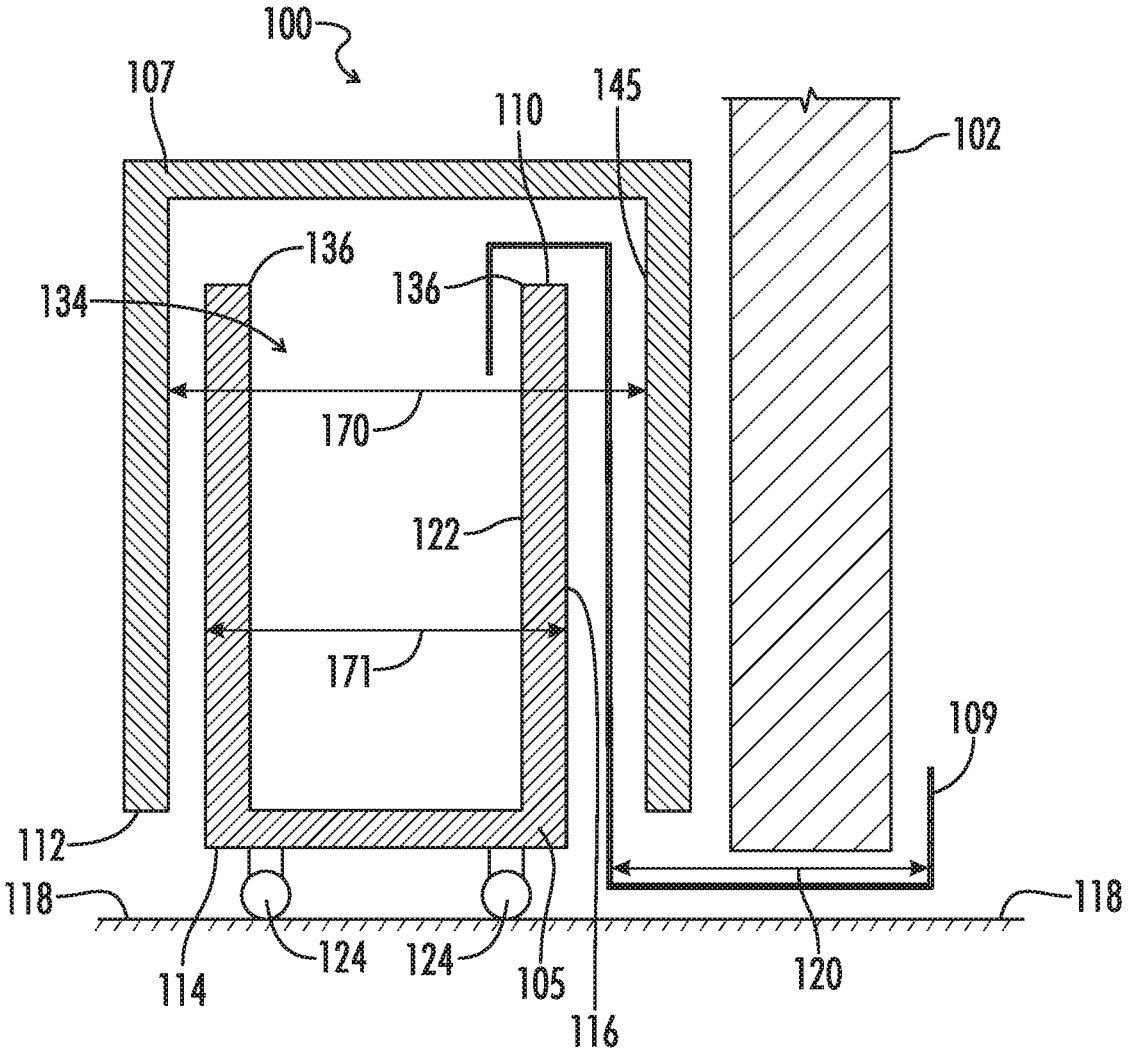
FIG. 5 is a side cutaway view of the package drop box of FIG. 1.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. As used herein, the assembled and upright position of the package drop box is with the cap and retention bracket secured to the base and the base supported by a surface that is generally horizontal as shown in FIGS. 1-5. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring now to FIGS. 1-5, a package drop box 100 is configured to secure to a garage door 102. The package drop box 100 includes a base 105, a cap 107, and a retention bracket 109. The base 105 has an open top 110. The cap 107 has an open bottom 112. The cap 107 is configured to secure to the base 105 when the package drop box 100 is assembled. In one embodiment, the package drop box 100 further includes a set of wheels 124 configured to attach to the base 105 and support the base 105 above the surface 118 supporting the package drop box 100 when the package drop box 100 is assembled and in the upright position.

In one embodiment, the cap 107 further includes a hatch 130 or lid hingedly attached to a top 132 of the cap 107 such that lifting the hatch 130 provides a user access to an interior space 134 of the package drop box 100 defined by the base 105 and the cap 107. In one embodiment, the hatch 130 or outline of the hatch substantially corresponds to an inside edge 136 of the top edge 110 of the base 105. In one embodiment, the package drop box 100 further includes a latch and lock 140. The latch and lock 140 are configured to cooperate to secure the hatch 130 in a closed position preventing access to the interior 134 of the package drop box 100. In an open position, the latch and lock 140 allow a user to open the hatch 130 and access the interior 134 of the package drop box 100.

The cap 107 has a first position and a second position. In the first position, the cap 107 is fitted over the base 105 such that a bottom edge 112 of the cap 107 is proximate a bottom edge 114 of the base 105. In the second position, the bottom edge 112 of the cap 107 is proximate a top edge 110 of the base 105. In one embodiment, the package drop box 100 further includes a pair of handles 160 configured to attach to the cap 107 that opposing lateral sides of the cap 107 proximate a top 132 of the cap 107 such that the user can apply force to the handles 160 to move the cap 107 from the first position to the second position and from the second position to the first position when the package drop box 100 is assembled.

In one embodiment, the base 105 further includes a pin 141 configured to extend outwardly from at least one outside vertical surface (e.g., the back 116) of the base 105 when the package drop box 100 is assembled. The cap 107 further includes a notch 143 in an interior surface 145 of said cap 107. The notch 143 corresponds to the pin 141 such that a user may raise the cap 107 with respect to the base 105 to the second position of the cap 107 while the pin 141 remains in the notch 143. The pin 141 limits upward travel of the cap 107 relative to the base 105 to prevent removal of the cap 107 from the base 105. The first position of the cap 107 provides a reduced storage size for the package drop box 100 while the second position of the cap 107 provides increased interior volume for the package drop box 100 to accommodate larger packages. In one embodiment, the pin 141 extends from the back 116 of the base 105 through the retention bracket 109 to secure the retention bracket 109 to the base 105 when the package drop box 100 is assembled. In one embodiment, the notch 143 has a vertical portion 147 and a lock portion 149. The lock portion 149 extends generally horizontally from the vertical portion 147 of the notch 143 proximate a bottom 150 of the notch 143 such that the pin 141 interlocks with the lock portion 149 of the notch 143 when the cap 107 is in the second position, and the pin 141 supports the cap 107 by interlocking with the lock portion 149 of the notch 143 when the cap 107 is in the second position. In one embodiment, the lock portion 149 of the notch 143 forms an acute angle with the vertical portion 147 of the notch with respect to an upper end 151 of the notch 143. In one embodiment, the pin 141 is the first pin 141, and the notch 143 is a first notch 143. The base 105 further includes a second pin 146 extending outwardly from the vertical surface (e.g., the back 116) of the base 105 when the package drop box 100 is assembled and in the upright position, and the cap 107 further includes a second notch 148 corresponding to the second pin 146. The first notch 143 and the second notch 148 have the same general shape. In one embodiment, the first pin 141 and the second pin 146 extend through the corresponding notches 143, 148 when the package drop box 100 is assembled.

The retention bracket 109 is configured to secure to the package drop box 100 when the package drop box 100 is assembled. The retention bracket 109 is configured to extend up a back 116 of the base 105 from a surface 118 supporting the package drop box 100, extend along the surface 118 away from the back 116 of the base 105, and extend vertically upward from the surface 118 supporting the package drop box 100 at a predetermined distance 120 from the back 116 of the base 105. In one embodiment, the retention bracket 109 is further configured to extend over the top edge 110 of the back 116 of the base 105, and down and inside surface 122 of the back 116 of the base 105 to secure the retention bracket 109 to the package drop box 100 when the package drop box 100 is assembled. In one embodiment, the retention bracket 109 is configured to extend up the back 116 of the base 105 between the first pin 141 and the second pin 146, over the top edge 110 of the base 105, and down and inside surface 122 of the back 116 of the base 105 to secure the retention bracket 109 to the package drop box 100 when the package drop box 100 is assembled. In one embodiment, the retention bracket 109 is formed of folded metal, however it is considered within the scope of the claims that the retention bracket 109 may be formed by plastic injection molding, metal stamping, or other methods. The retention bracket 109 is configured such that when the package drop box 100 is backed up to a garage door (outside the garage) and the garage door is lowered, the package drop box 100 cannot be pulled away from the garage door because the retention bracket 102 is secured to the base 105 and extends upward behind the closed garage door. In one embodiment, the retention bracket 109 extends up from the surface between about 1 inch and 6 inches.

In one embodiment, the cap 107 and base 105 are formed of wood. However it is contemplated within the scope of the claims that the cap 107 and base 105 may be formed of other materials such as injection molded plastic or roto molded plastic. In one embodiment, the cap 107 has an internal depth 170 greater than an external death 171 of the base 105 by between 0.1 inches and 1 inch. In one embodiment, the cap 107 has an internal lateral width 173 greater than an external lateral width 174 of the base 105 by between 0.75 and 3 inches. In one embodiment, the notch 143 of the cap 107 has a vertical portion 147 extending between 6 inches and 24 inches. In one embodiment, the notch 143 of the cap 107 has a lock portion 149 extending generally horizontally (i.e., laterally) between 0.75 inches and 3 inches. In one embodiment, the base has a height of approximately 16 inches, a width of approximately 33 inches, and a depth of approximately 15 inches. In one embodiment, the cap 107 has a height of approximately 16 inches, a width of approximately 36 inches, and a depth of approximately 16 inches. In one embodiment, the hatch 130 has a depth of approximately 13.5 inches, and a width of approximately 31.5 inches. In one embodiment, the notch 143 has an overall height of approximately 12 inches, and the locking portion 141 of the notch 143 extends upward at a 45° angle from the bottom 150 of the notch 143 for approximately 3 inches. In one embodiment, the predetermined distance 120 that the retention bracket 109 extends back approximately 10 inches from the back 116 of the base 105 before extending upward from the surface supporting the package drop box 100.

In use, the user leaves the package drop box 100 outside the user's garage door and secured to the garage door by lowering the garage door on the retention bracket 109. The user leaves the latch and lock 140 unlocked. A delivery person opens the hatch 130, places one or more packages in the interior space 134 of the package drop box 100, and closes and locks the hatch 130 and lock 140. The user can then unlock the secure package drop box 100 when the user returns home either before or after wheeling the drop box 100 into the user's garage. It is also contemplated within the scope of the claims that the latch and lock 140 may be an electronic token access lock. In this way, multiple delivery agents may be provided rotating electronic codes to access the package drop box 100 throughout the day with the codes changing on a daily basis.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful MOBILE EXPANDABLE HARD SIDED PACKAGE SECURITY DROP BOX it is not intended that such references be construed as limitations upon the scope of this invention except as set forth in the following claims.

What is claimed is:

1. A package drop box comprising:

a base having an open top;

a cap having an open bottom, said cap having a first position and a second position, wherein:

the cap is configured to secure to the base when the package drop box is assembled to define an interior volume of the package drop box;

in the first position, the cap is fitted over the base such that a bottom edge of the cap is proximate a bottom edge of the base; and in the second position, the bottom edge of the cap is proximate a top edge of the base; and a retention bracket configured to secure to the package drop box when the package drop box is assembled, and wherein said retention bracket is configured to extend up a back of the base from a surface supporting the package drop box, extend along the surface away from the back of the base, and extend vertically upward from the surface supporting the package drop box at a predetermined distance from the back of the base.

2. The package drop box of claim 1, wherein:

the retention bracket is further configured to extend over the top edge of the base, and down an inside surface of the back of base to secure the retention bracket to the package drop box when the package drop box is assembled.

3. The package drop box of claim 1, further comprising a set of wheels configured to attach to the base and support the base above the surface supporting the package drop box when the package drop box is assembled.

4. The package drop box of claim 1, wherein:

the cap comprises a hatch hingedly attached to a top of the cap such that lifting the hatch provides a user access to the interior of the package drop box defined by the base and the cap.

5. The package drop box of claim 1, wherein:

the cap comprises a hatch hingedly attached to a top of the cap such that lifting the hatch provides a user access to the interior of the package drop box defined by the base and the cap; and the package drop box further comprises a latch and a lock, wherein the latch and the lock are configured to cooperate to secure the hatch in a closed position preventing access to the interior of the package drop box.

6. The package drop box of claim 1, wherein:

the base further comprises at least one pin configured to extend outwardly from at least one outside vertical surface of said base when the package drop box is assembled and in an upright position; and the cap further comprises a notch in an interior surface of said cap, said notch corresponding to the pin such that a user may raise the cap with respect to the base to the second position of the cap while the pin remains in the notch and the pin limits upward travel of the cap relative to the base to prevent removal of the cap from the base.

7. The package drop box of claim 1, wherein:

the base further comprises at least one pin configured to extend outwardly from at least one outside vertical surface of said base when the package drop box is assembled and in an upright position;

the cap further comprises a notch in an interior surface of said cap, said notch corresponding to the pin such that a user may raise the cap with respect to the base to the second position of the cap while the pin remains in the notch and the pin limits upward travel of the cap relative to the base to prevent removal of the cap from the base; and the pin extends from the back of the base through the retention bracket to secure the retention bracket to the base when the package drop box is assembled.

8. The package drop box of claim 1, wherein:

the base further comprises at least one pin configured to extend outwardly from at least one outside vertical surface of said base when the package drop box is assembled and in an upright position;

the cap further comprises a notch in an interior surface of said cap, said notch corresponding to the pin such that a user may raise the cap with respect to the base to the second position of the cap while the pin remains in the notch and the pin limits upward travel of the cap relative to the base to prevent removal of the cap from the base;

the notch has a vertical portion and a lock portion, said lock portion extending horizontally from the vertical portion of the notch proximate a bottom of the notch such that the pin interlocks with the lock portion of the notch when the cap is in the second position and the pin supports the cap by interlocking with the lock portion of the notch when the cap is in the second position.

9. The package drop box of claim 1, wherein:

the base further comprises at least one pin configured to extend outwardly from at least one outside vertical surface of said base when the package drop box is assembled and in an upright position;

the cap further comprises a notch in an interior surface of said cap, said notch corresponding to the pin such that a user may raise the cap with respect to the base to the second position of the cap while the pin remains in the notch and the pin limits upward travel of the cap relative to the base to prevent removal of the cap from the base;

the notch has a vertical portion and a lock portion, said lock portion extending horizontally from the vertical portion of the notch proximate a bottom of the notch such that the pin interlocks with the lock portion of the notch when the cap is in the second position and the pin supports the cap by interlocking with the lock portion of the notch when the cap is in the second position; and the lock portion of the notch forms an acute angle with the vertical portion of the notch with respect to an upper end of the notch.

10. The package drop box of claim 1, wherein:

the base further comprises at least one pin configured to extend outwardly from at least one outside vertical surface of said base when the package drop box is assembled and in an upright position; and the cap further comprises a notch in an interior surface of said cap, said notch corresponding to the pin such that a user may raise the cap with respect to the base to the second position of the cap while the pin remains in the notch and the pin limits upward travel of the cap relative to the base to prevent removal of the cap from the base;

the pin is a first pin;

the notch is a first notch;

the base further comprises a second pin configured to extend outwardly from the vertical surface of the base when the package drop box is assembled and in the upright position; and the cap further comprises a second notch corresponding to the second pin.

11. The package drop box of claim 1, wherein:

the base further comprises at least one pin configured to extend outwardly from at least one outside vertical surface of said base when the package drop box is assembled and in an upright position;

the cap further comprises a notch in an interior surface of said cap, said notch corresponding to the pin such that a user may raise the cap with respect to the base to the second position of the cap while the pin remains in the notch and the pin limits upward travel of the cap relative to the base to prevent removal of the cap from the base; and the pin extends through the corresponding notch when the package drop box is assembled.

12. The package drop box of claim 1, wherein:

the base further comprises at least one pin configured to extend outwardly from at least one outside vertical surface of said base when the package drop box is assembled and in an upright position; and the cap further comprises a notch in an interior surface of said cap, said notch corresponding to the pin such that a user may raise the cap with respect to the base to the second position of the cap while the pin remains in the notch and the pin limits upward travel of the cap relative to the base to prevent removal of the cap from the base;

the pin is a first pin;

the notch is a first notch;

the base further comprises a second pin extending configured to extend outwardly from the vertical surface of the base when the package drop box is assembled and in the upright position;

the cap further comprises a second notch corresponding to the second pin; and the retention bracket is further configured to extend up the back of the base between the first pin and the second pin, over the top edge of the base, and down an inside surface of the back of base to secure the retention bracket to the package drop box when the package drop box is assembled.

13. The package drop box of claim 1, further comprising a pair of handles configured to attach to the cap at opposing lateral sides of the cap proximate a top of the cap such that the user can apply force to the handles to move the cap from the first position to the second position and from the second position to the first position when the package drop box is assembled.

14. The package drop box of claim 1, wherein:

the cap has an internal depth greater than an external depth of the base by between 0.1 inches and 1 inch.

15. The package drop box of claim 1, wherein:

the cap has an internal lateral width greater than an external lateral width of the base by between 0.75 and 3 inches.

16. The package drop box of claim 1, wherein:

the cap further comprises a notch having a vertical portion extending between 6 inches and 24 inches.

17. The package drop box of claim 1, wherein:

the cap further comprises a notch comprising a lock portion, said lock portion extending horizontally at least 0.75 inches.

18. The package drop box of claim 1, wherein:

the cap further comprises a notch comprising a lock portion, said lock portion extending horizontally between 0.75 inches and 3 inches.

19. The package drop box of claim 1, wherein:

the retention bracket is formed of folded metal.

* * * * *